US007716788B2

(12) United States Patent
Lin

(10) Patent No.: US 7,716,788 B2
(45) Date of Patent: May 18, 2010

(54) HINGE FOR A TABLET COMPUTER EXTENSION PAD

(75) Inventor: Chung-Yi Lin, Taipei Hsien (TW)

(73) Assignee: Shin Zu Shing Co., Ltd., Taipei Hsien (TW)

( * ) Notice: Subject to any disclaimer, the term of this patent is extended or adjusted under 35 U.S.C. 154(b) by 469 days.

(21) Appl. No.: 11/833,302

(22) Filed: Aug. 3, 2007

(65) Prior Publication Data

US 2009/0031532 A1 Feb. 5, 2009

(51) Int. Cl.
*E05D 11/10* (2006.01)

(52) U.S. Cl. ..... 16/330; 16/326; 16/348; 16/374

(58) Field of Classification Search ..... 16/330, 16/303, 341, 342, 328, 329, 331, 326, 348, 16/374; 379/433.12, 433.13; 455/575.1, 455/575.3, 575.4, 575.8, 550.1, 90.3; 361/679.08, 361/679.11, 679.12, 679.27; 348/373, 333.06, 348/794

See application file for complete search history.

(56) References Cited

U.S. PATENT DOCUMENTS 765,372 A * 7/1904 Bading ..... 16/285
5,467,504 A * 11/1995 Yang ..... 16/342
5,600,868 A * 2/1997 Tourville et al. ..... 16/277
5,749,124 A * 5/1998 Lu ..... 16/307
6,671,929 B1 * 1/2004 Lu ..... 16/342
6,678,539 B1 * 1/2004 Lu ..... 455/575.1
6,748,625 B2 * 6/2004 Lu ..... 16/285
6,754,081 B2 * 6/2004 Rude et al. ..... 361/725
6,807,711 B2 * 10/2004 Lu ..... 16/321
6,820,307 B2 * 11/2004 Lu ..... 16/342
6,868,582 B2 * 3/2005 Lu et al. ..... 16/342
7,117,562 B2 * 10/2006 Zuo et al. ..... 16/303

* cited by examiner

*Primary Examiner*—Chuck Y. Mah
(74) *Attorney, Agent, or Firm*—Rabin & Berdo, P.C.

(57) ABSTRACT

An extension pad has a clamp device to hold a tablet computer on the extension pad securely. The clamp device has a mounting base and a rotating clamp. A hinge for a tablet computer extension pad in accordance with the present invention is mounted in the clamp device and has a pivoting leaf, a limiting segment, a stationary leaf and a spring. The pivoting leaf is mounted in the rotating clamp. The limiting segment is mounted around the pivoting leaf to selectively limit rotation of the rotating clamp. The stationary leaf is mounted rotatably on the pivoting leaf and is mounted securely in the mounting base. The spring is mounted between the pivoting leaf and the stationary leaf. Consequently, the hinge allows the clamp device to hold the tablet computer securely on the extension pad.

8 Claims, 6 Drawing Sheets

HINGE FOR A TABLET COMPUTER EXTENSION PAD

BACKGROUND OF THE INVENTION

1. Field of the Invention

The present invention relates to a hinge, and more particularly to a hinge mounting in a tablet computer extension pad to allow the extension pad to be mounted on the tablet computer securely.

2. Description of the Prior Arts

Tablet computers are different to desktop computers and notebooks, as tablet computers do not have a solid keyboard and a pivotal cover, are thin, light and are designed to be highly portable. Peripheral products such as extension pads are designed to make the tablet computers more convenient to use by providing users additional space to add their desired functionality, such as an extra hard disk, a fan, or the like. An extension pad is mounted below the tablet computer to raise an operating height for the user, has a slot for the tablet computer to insert into, but do not mount the tablet computer securely, so the tablet computer might slide out of the extension pad unexpectedly when being moved or carried.

To overcome the shortcomings, the present invention provides a hinge for a tablet computer extension pad to mitigate or obviate the aforementioned problems.

SUMMARY OF THE INVENTION

The primary objective of the present invention is to provide a hinge for an extension pad to allow the extension pad to mount a tablet computer securely.

The extension pad has a clamp device to mount the tablet computer on the extension pad. The clamp device has a mounting base and a rotating clamp. The hinge for a tablet computer extension pad in accordance with the present invention is mounted in the clamp device and has a pivoting leaf, a limiting segment, a stationary leaf and a spring. The pivoting leaf is mounted in the rotating clamp. The limiting segment is mounted around the pivoting leaf to selectively limit rotation of the rotating clamp. The stationary leaf is mounted rotatably on the pivoting leaf and is mounted securely in the mounting base. The spring is mounted between the pivoting leaf and the stationary leaf. Consequently, the hinge allows the clamp device to mount the tablet computer securely on the extension pad.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
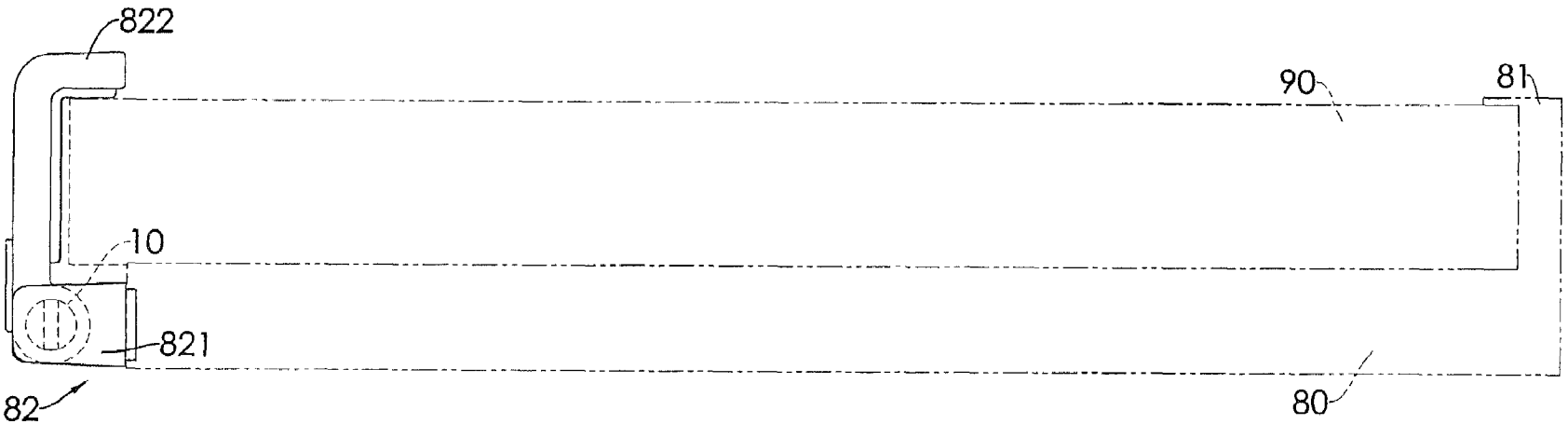
FIG. 1 is a side view of a hinge for a tablet computer extension pad in accordance with the present invention mounted in an extension pad mounted to a tablet computer.
Figure 2:
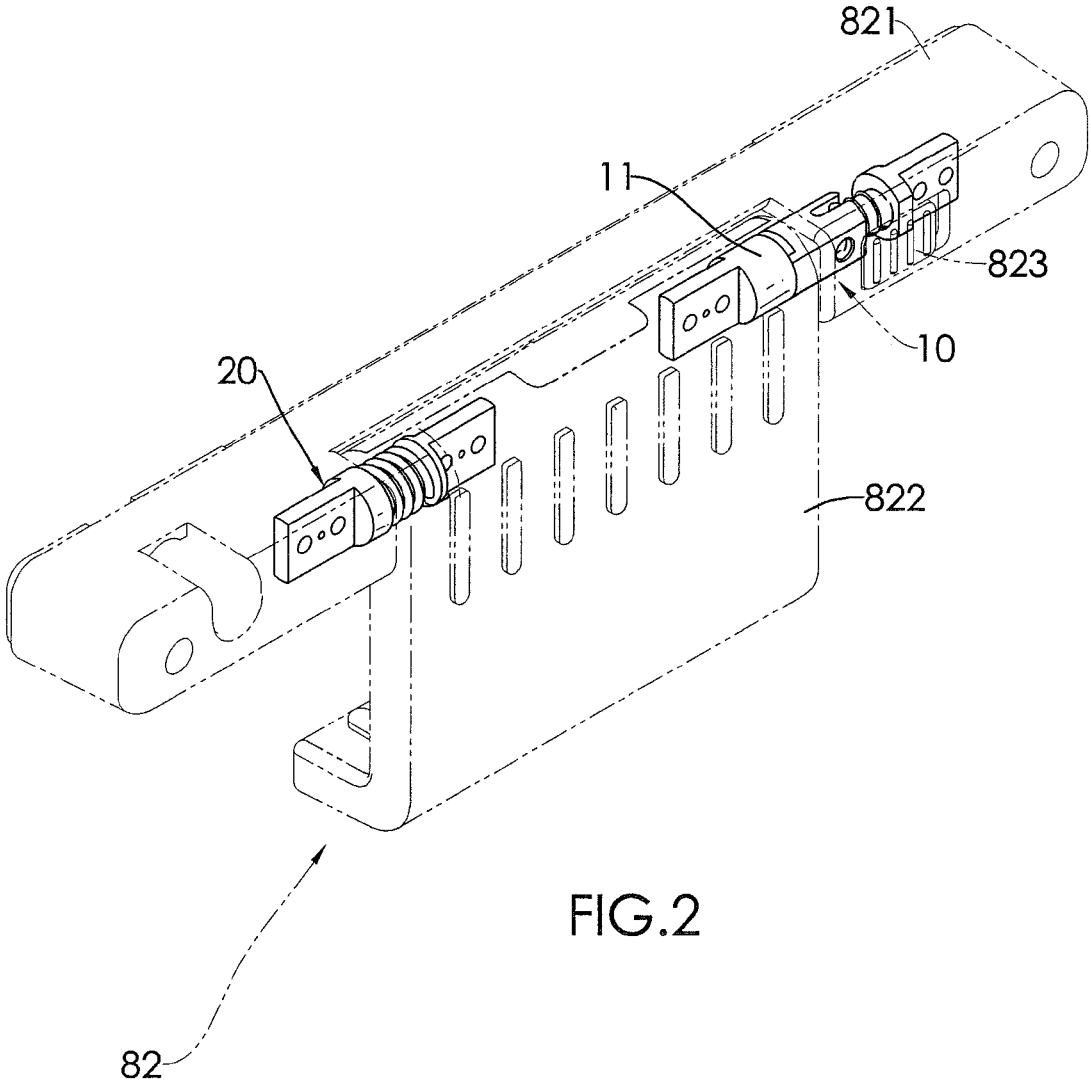
FIG. 2 is a perspective view of the hinge in FIG. 1 mounted in a clamp device of an extension pad with an assistant hinge.

With reference to FIGS. 1 and 2, an extension pad (80) for a tablet computer (90), is a flat panel, is mounted below the tablet computer (90) and has a front surface, a top end, a bottom end, an inserting slot (81) and a clamp device (82). The inserting slot (81) is formed from the front surface at the bottom end of the extension pad (80) and is mounted detachably around the tablet computer (90). The clamp device (82) is mounted on the top end of the extension pad (80) to selectively hold the tablet computer (90) securely on the front surface when the tablet computer (90) is mounted in the inserting slot (81) and has a mounting base (821), a rotating clamp (822) and an external lock (823).

The mounting base (821) is formed on the top end of the extension pad (80) and has two sides and a recessed central segment. The rotating clamp (822) is mounted rotatably in the central segment of the mounting base (821), between the sides of the mounting base (821), extends past and clamps onto the front surface of the extension pad (80), selectively clamps the tablet computer (90) to mount the tablet computer (90) securely and has two sides. The two sides of the rotating clamp (822) respectively abut the two sides of the mounting base (821). The external lock (823) is mounted slidably in and protrudes out of one end of the mounting base (821) to allow a user to selectively lock rotation of the rotating clamp (822) by sliding the external lock (823).

Figure 3:
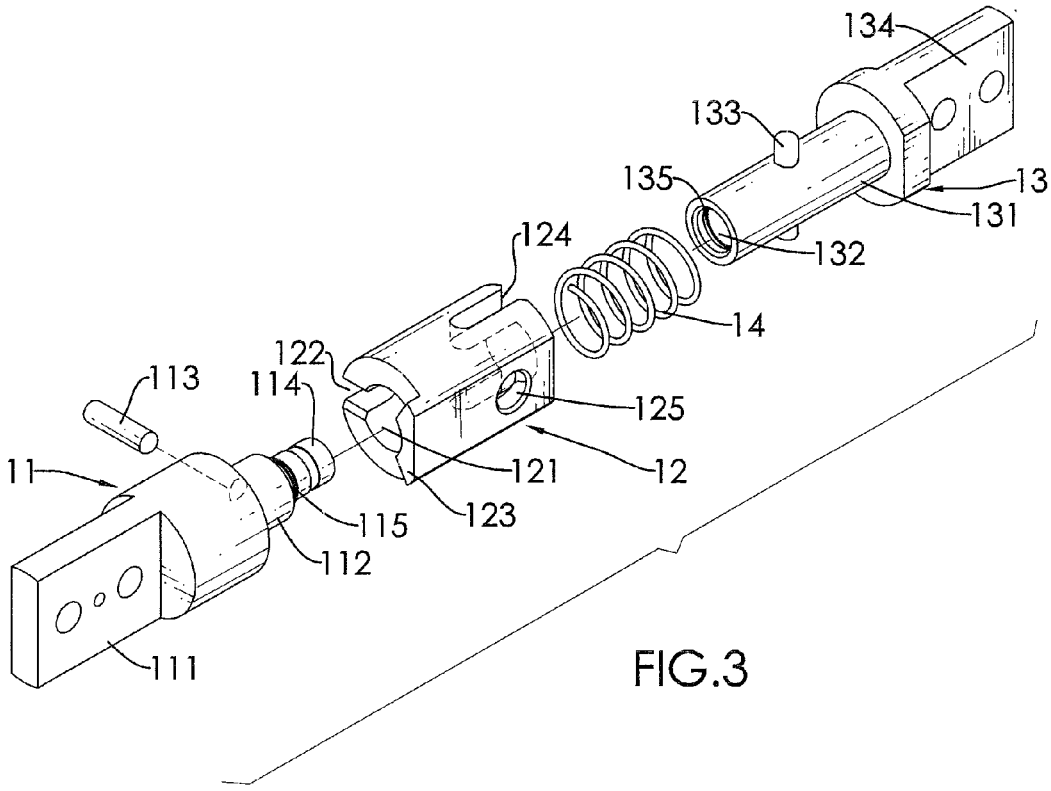
FIG. 3 is an exploded perspective view of the hinge in FIG. 1.
Figure 9:
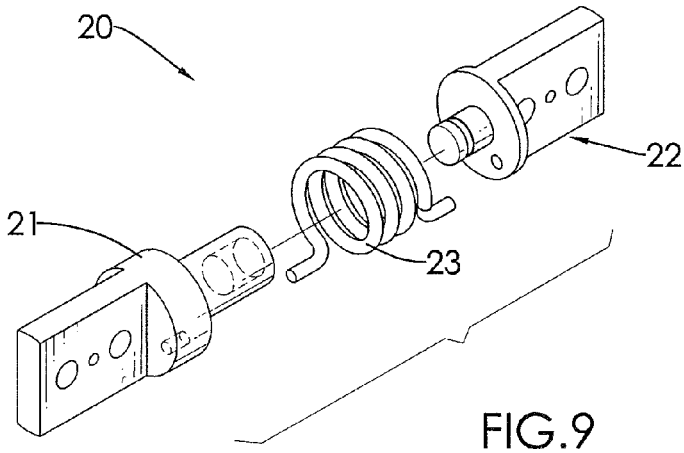
FIG. 9 is a perspective view of the assistant hinge in FIG. 2.

With further reference to FIGS. 3 and 9, a hinge (10) for a tablet computer extension pad in accordance with the present invention is mounted in the clamp device (82) of the extension pad (80), may cooperate with an assistant hinge (20) and comprises a pivoting leaf (11), a limiting segment (12), a stationary leaf (13) and a spring (14).

The pivoting leaf (11) is mounted securely in one side of the rotating clamp (822) abuts the end of the mounting segment (821) in which the external lock (823) is mounted and has a proximal end, a distal end, a mounting segment (111), a pintle (112), a limiting pin (113) and may have a mounting protrusion (114).

The mounting segment (111) is formed on and protrudes from the proximal end of the pivoting leaf (11), is mounted securely in the clamp (822) and may have at least one mounting hole. The mounting hole is formed through the mounting segment (111) of the pivoting leaf (11).

The pintle (112) is formed coaxially on and extends from the distal end of the pivoting leaf (11) and has a distal end and a pinhole. The pinhole is formed transversely in the pintle (112).

The limiting pin (113) is mounted securely in the pinhole in the pintle (112) and extends out of the pintle (112).

The mounting protrusion (114) is formed coaxially on and protrudes from the distal end of the pintle (112) and has a mounting flange (115). The mounting flange (115) is formed around the mounting protrusion (114).

Figure 4:
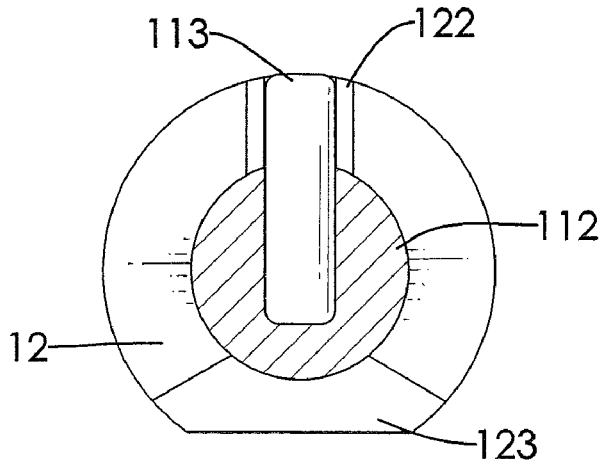
FIG. 4 is a side view in partial section of the hinge in FIG. 3.
Figure 5:
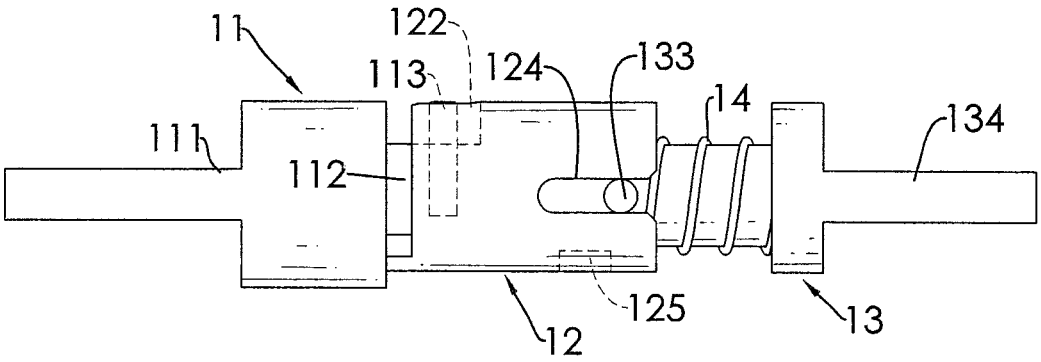
FIG. 5 is a front view of the hinge in FIG. 3.

With further reference to FIGS. 4 and 5, the limiting segment (12) is tubular, is mounted slidably and rotatably around the pivoting leaf (11), is connected securely with the external lock (823) and slides synchronously with the external lock (823) and has a pivoting end, a stationary end, an outside wall, a pivoting hole (121), a limiting slot (122), an optional limit (123), at least one guide slot (124) and may have a lock mount (125).

The pivoting end of the limiting segment (12) abuts the distal end of the pivoting leaf (11).

The pivoting hole (121) is formed coaxially through the limiting segment (12) and has a pivoting end and a stationary end. The pivoting end of the pivoting hole (121) is mounted slidably and rotatably around the pintle (112).

The limiting slot (122) is formed longitudinally in the proximal end of the limiting segment (12), communicates with the pivoting hole (121), corresponds to the limiting pin (113) and selectively engages the limiting pin (113) when the external lock (823) is released to lock the rotation of the rotating clamp (822).

The limit (123) is formed longitudinally on and protrudes from the pivoting end of the limiting segment (12), corresponds to the limiting pin (113) and selectively abuts the limiting pin (113) to limit the rotation of the pivoting leaf (11) in both directions when external lock (823) is open to allow rotation.

The at least one guide slot (124) is formed longitudinally in the stationary end of the limiting segment (12) and communicates with the pivoting hole (121).

The lock mount (125) is formed on the outside wall of the limiting segment (12), corresponds to and connects securely to the external lock (823).

The stationary leaf (13) is mounted rotatably on the pivoting leaf (11), is mounted slidably through the stationary end of the limiting segment (12), is mounted securely in the corresponding end of the mounting base (821) to allow the rotating clamp (822) to pivot relative to the mounting base (821) and has a proximal end, a distal end, a shaft (131), an optional pivoting recess (132), at least one guide pin (133) and a mounting segment (134).

The shaft (131) is formed coaxially on and extends from the distal end of the stationary leaf (13), is mounted slidably in the stationary end of the pivoting hole (121), attaches rotatably to the distal end of the pintle (112) and has a distal end.

The pivoting recess (132) is formed coaxially in the distal end of the shaft (131), corresponds to and is mounted rotatably around the mounting protrusion (114) and has an inner wall and a groove (135). The groove (135) is formed in the inner wall of the pivoting recess (132), corresponds to and is mounted securely around the mounting flange (115) to prevent the pivoting leaf (11) from detaching.

The at least one guide pin (133) is mounted transversely in and extends from the shaft (131), corresponds to, is mounted slidably in and engages the guide slot (124) to prevent the limiting segment (12) from rotating.

The mounting segment (134) of the stationary leaf (13) is formed on the proximal end of the stationary leaf (13), is mounted securely in the mounting base (821) and may have at least one mounting hole. The mounting hole is formed through the mounting segment (134) of the stationary leaf (13).

Figure 7:
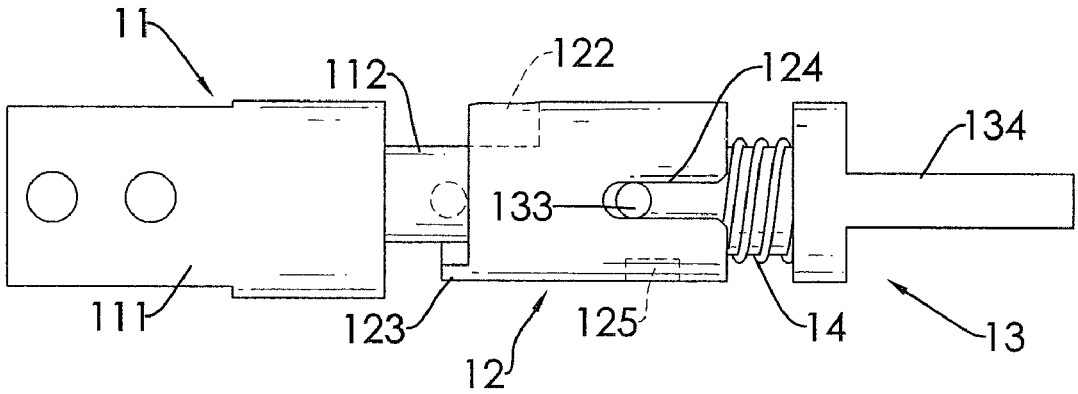
FIG. 7 is an operational front view of the hinge in FIG. 3, wherein the pivoting leaf is shown rotated.
Figure 6:
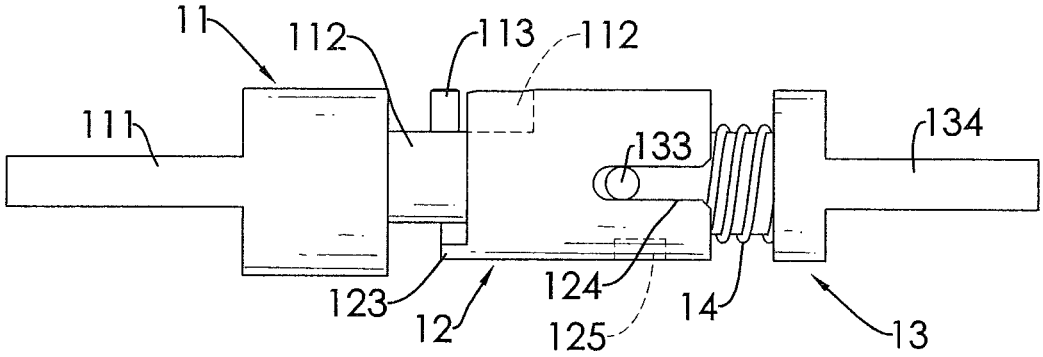
FIG. 6 is an operational front view of the hinge in FIG. 3, shown unlocked.
Figure 8:
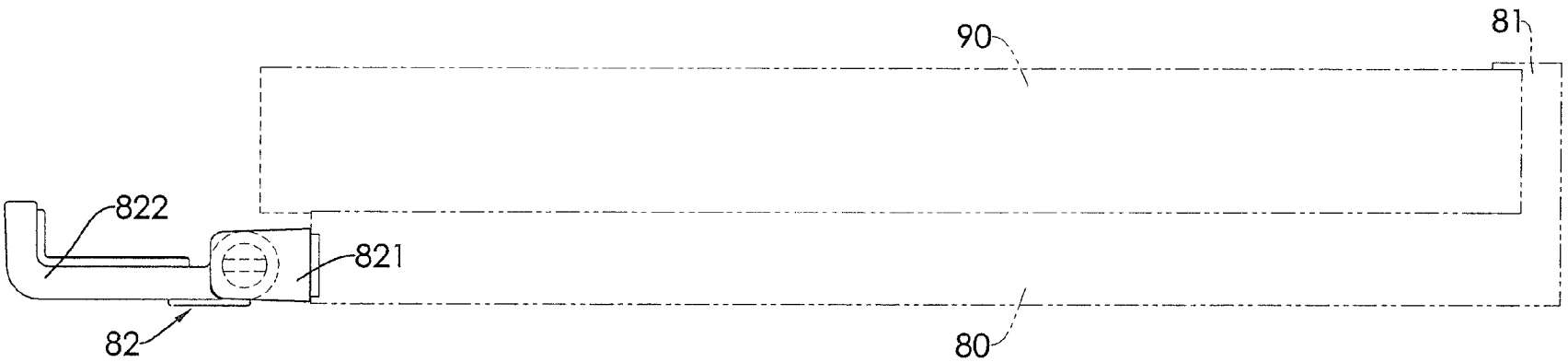
FIG. 8 is an operational side view of a hinge in FIG. 3 applied in an extension pad with the clamp device unlocked.

With further reference to FIGS. 6, 7 and 8, the spring (14) is mounted around the shaft (131), is mounted between and presses against the distal end of the stationary leaf (13) and the stationary end of the limiting segment (12) to prevent the limiting segment (12) from moving to keep the limiting segment (12) engaging the pivoting leaf (11), unless held back by the external lock (823). When the user opens the external lock (823) to slide the limiting segment (12) against the spring (14), to allow rotation of the pivoting leaf (11) and the clamp (822) can be rotated to remove the tablet computer (90).

The assistant hinge (20) is mounted between the other end of the mounting base (821) and the corresponding end of the rotating clamp (822), provides torsion to allow the rotating clamp (822) to move back automatically after the rotating clamp (822) rotates and has an assistant stationary leaf (21), an assistant pivoting leaf (22) and a torsion spring (23).

The assistant stationary leaf (21) is mounted securely in the mounting base (821) and has a distal end.

The assistant pivoting leaf (22) is mounted rotatably on the distal end of the assistant stationary leaf (21) and is mounted securely in the corresponding end of the rotating clamp (822).

The torsion spring (23) is mounted between and presses against the assistant stationary leaf (21) and the assistant pivoting leaf (22).

Consequently, the tablet computer (90) can be mounted on and held securely on the front surface of the extension pad (80) by the clamp device (82) when the hinge locks the rotation of the clamp device (82) and be removed from the extension pad (80) simply when the hinge release the rotation of the clamp device (82).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A hinge for a tablet computer extension pad comprising a pivoting leaf having a proximal end;

a distal end;

a mounting segment being formed on and protruding from the proximal end of the pivoting leaf;

a pintle being formed coaxially on and extending from the distal end of the pivoting leaf and having a distal end; and a pinhole being formed transversely in the pintle; and a limiting pin being mounted securely in the pinhole in the pintle and extending out of the pintle;

a limiting segment being tubular, being mounted slidably and rotatably around the pivoting leaf and having a pivoting end abutting the distal end of the pivoting leaf;

an opposite stationary end;

an outside wall;

a pivoting hole being formed coaxially through the limiting segment and having a pivoting hole end being mounted slidably and rotatably around the pintle; and an opposite stationary hole end;

a limiting slot being formed longitudinally in the proximal end of the limiting segment, communicating with the pivoting hole, corresponding to and selectively engaging the limiting pin; and at least one guide slot being formed longitudinally in the stationary end of the limiting segment and communicating with the pivoting hole;

a stationary leaf being mounted rotatably on the pivoting leaf, being mounted slidably through the stationary end of the limiting segment and having a proximal end;

a distal end;

a shaft being formed coaxially on and extending from the distal end of the stationary leaf, being mounted slidably in the stationary end of the pivoting hole, attached rotatably to the distal end of the pintle and having a distal end;

at least one guide pin being mounted transversely in and extending from the shaft, corresponding to, being mounted slidably in and engaging the guide slot; and a mounting segment being formed on the proximal end of the stationary leaf; and a spring being mounted around the shaft of the stationary leaf, being mounted between and pressing against the distal end of the stationary leaf and the stationary end of the limiting segment.

2. The hinge as claimed in claim 1, wherein the limiting segment further has a lock mount being formed on the outside wall of the limiting segment.

3. The hinge as claimed in claim 1, wherein the limiting segment further has a limit being formed longitudinally on and protruding from the pivoting end of the limiting segment, corresponding to the limiting pin and selectively abutting the limiting pin.

4. The hinge as claimed in claim 1, wherein the pivoting leaf further has a mounting protrusion being formed coaxially on and protruding from the distal end of the pintle of the pivoting leaf and having a mounting flange being formed around the mounting protrusion; and the stationary leaf further has a pivoting recess being formed coaxially in the distal end of the shaft of the stationary leaf, corresponding to and being mounted rotatably around the mounting protrusion and having an inner wall; and a groove being formed in the inner wall of the pivoting recess, corresponding to and being mounted securely around the mounting flange.

5. The hinge as claimed in claim 1, wherein the mounting segments of the pivoting leaf and the stationary leaf further respectively have at least one mounting hole being formed through the mounting segment.

6. The hinge as claimed in claim 2, wherein the limiting segment further has a limit being formed longitudinally on and protruding from the pivoting end of the limiting segment, corresponding to the limiting pin and selectively abutting the limiting pin.

7. The hinge as claimed in claim 3, wherein the pivoting leaf further has a mounting protrusion being formed coaxially on and protruding from the distal end of the pintle of the pivoting leaf and having a mounting flange being formed around the mounting protrusion; and the stationary leaf further has a pivoting recess being formed coaxially in the distal end of the shaft of the stationary leaf, corresponding to and being mounted rotatably around the mounting protrusion and having an inner wall; and a groove being formed in the inner wall of the pivoting recess, corresponding to and being mounted securely around the mounting flange.

8. The hinge as claimed in claim 4, wherein the mounting segments of the pivoting leaf and the stationary leaf further respectively have at least one mounting hole being formed through the mounting segment.

* * * * *